United States Patent [19]

Slenker

[11] Patent Number: 5,021,005

[45] Date of Patent: Jun. 4, 1991

[54] FLEXIBLE CONDUCTOR CONNECTOR

[76] Inventor: Stephen Slenker, 26 Cummings Rd., Tyngsboro, Mass. 01879

[21] Appl. No.: 489,375

[22] Filed: Mar. 6, 1990

[51] Int. Cl.[5] ..... H01R 4/24

[52] U.S. Cl. ..... 439/421; 439/874; 29/863

[58] Field of Search ..... 439/874–876, 439/877, 421–424, 936, 86, 90; 174/117 FF, 117 A; 29/857, 859, 865, 866, 867, 860, 862, 863

[56] References Cited

U.S. PATENT DOCUMENTS

| | | | |
|---|---|---|---|
| 3,158,423 | 11/1964 | Price | 439/932 |
| 3,697,925 | 10/1972 | Henschen | 439/422 |
| 3,757,087 | 9/1973 | Bernard | 174/117 A |
| 4,310,208 | 1/1982 | Webster et al. | 439/483 |
| 4,669,798 | 6/1987 | Daum et al. | 439/423 |
| 4,731,503 | 3/1988 | Kitanishi | 174/117 A |
| 4,818,823 | 4/1989 | Bradley | 174/117 A |
| 4,881,911 | 11/1989 | Haddock et al. | 439/484 |

*Primary Examiner*—David L. Pirlot
*Attorney, Agent, or Firm*—Wolf, Greenfield & Sacks

[57] ABSTRACT

A flexible conductor connector in the form of a flat metal foil laminated with alternate layers of adhesive and plastic, having a metal spade plug connector attached to its end. The metal foil may be exposed and bonded to the metal connector by means of a conductive adhesive. The spade connector may be provided with a pair of wrap-around arms having teeth at their ends and the conductor has a portion of one side of its laminate removed down to the bare metal foil. The arms are crimped around the laminated foil and the teeth engaged into a plastic layer but not penetrating to the foil. Further piercing teeth may be provided on a second set of arms to extend through the entire laminate and mechanically affix the conductor lead end to the connector.

4 Claims, 1 Drawing Sheet

FLEXIBLE CONDUCTOR CONNECTOR

FIELD OF THE INVENTION

This invention relates to flexible circuit connectors and is more particularly concerned with a very thin metal foil laminated conductor, which has applied to it a metal connector.

BACKGROUND OF THE INVENTION

Flexible circuits have been used which typically employ very thin metal foil laminated to mylar or other flexible plastic. The connector normally employed in such a circuit usually has small metal prongs that pierce the laminate and then curve around and pierce the laminate again. Such a construction may provide an adequate connection for the laminate containing copper foil, but generally has relatively little strength. It does not provide an adequate connection for a laminate containing aluminum foil. Since aluminum is much thinner and more ductile than copper and the resistance is typically high, it has been found that this type of construction has proven to be inadequate. Sometimes no contact results because the adhesives in the laminate insulate the contacts. Also, since the aluminum has so little strength the conductor may be easily removed. The extreme ductility of aluminum also tends to reduce the conductivity of the connection in time by migration of the aluminum in almost all aluminum connections.

It is one object of the invention to provide a connector for flexible circuits which affords adequate strength in the connection, regardless of the metal conductor being employed.

It is a further object of the invention to provide a connector for a flexible circuit employing aluminum metal foil which offers much lower resistance than previously employed connectors for aluminum foil.

It is a still further object of the invention to provide a strain relief mechanism in a connector for aluminum foil circuits in order to reduce or eliminate problems associated with relative motion between the connector and the laminate.

Another object of the invention is to provide a connector for aluminum foil flexible circuits which improves its resistance when subjected to the normal tension associated with connectors of this type.

SUMMARY OF THE INVENTION

The flexible circuit connector of the invention enables the use of flexible circuits in power applications where it may be necessary to carry currents of over 1 amp, and provides adequate strength and reliability. Applications for such a flexible circuit connector are found in boot and shoe heaters, electric blankets, heating pads, etc.

In the connector of the invention, two sets of arms are provided in the connector element which separately enclasp the metal foil connector so as to form the electrical circuit and pierce and enclasp the laminate foil in order to provide mechanical strength.

The above and further objects of the invention will become more readily apparent upon an examination of the drawings and a reading of the description following hereinafter.

BRIEF DESCRIPTION OF THE DRAWINGS

The invention is illustrated in the drawings, in which.

DETAILED DESCRIPTION OF THE INVENTION

Figure 1:
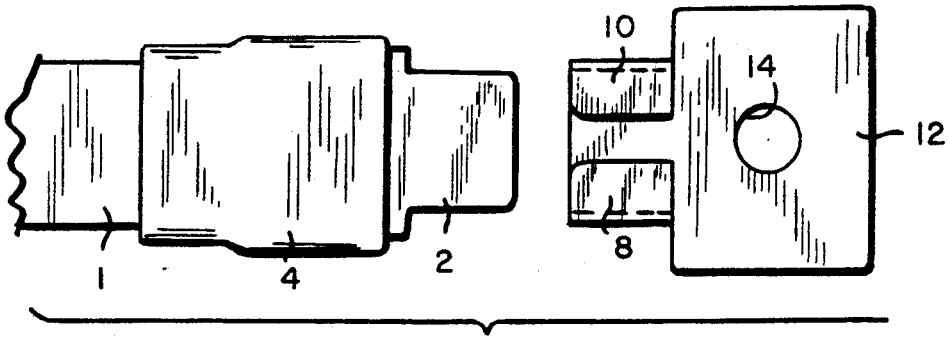
FIG. 1 is a plan view of a flexible conductor and connector.

As shown in FIG. 1, an in-line flexible conductor connector is illustrated in which a laminated thin metal foil 1 has affixed to the end thereof a metal spade connector 2 which is covered with a shrink tubing 4 made of plastic. This spade connector 2 mates with a female connector 12 which is provided with a pair of terminal clamps 8 and 10 into which the spade 2 fits. The connector 12 is provided with a hole 14 for its mounting to the device which is to receive power.

Figure 2:
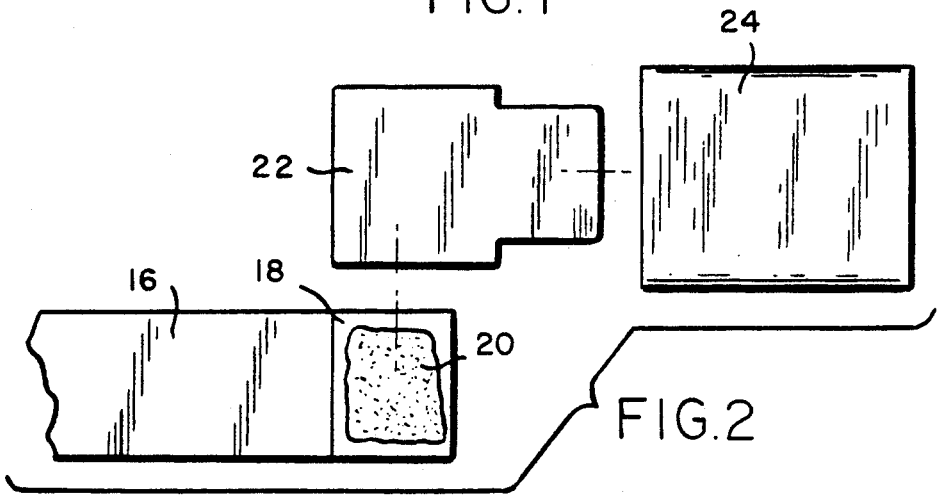
FIG. 2 is an exploded plan view of a flexible conductor and spade plug connector of the inline type.

One form of connection of the spade plug to the laminated foil is shown in FIG. 2 wherein the flexible conductor 16 has a portion of its plastic laminate removed down to the bare metal at 18 and has applied to it a conductive adhesive 20. Such adhesive may, for example, be an electrically conductive epoxy, such as that provided by Epoxy Technology known as H20E. By using this material to bond the metal foil to the aluminum spade plug 22, a superior joint can be prepared. The shrink tubing 24 is fitted over this connector and shrunk to render the laminate less flexible and more protected in the critical area of its assembly to the connector.

Particularly in the case of boot and shoe heaters, the flexible conductor connector must be easily manufacturable, must be relatively inexpensive and extremely rugged and reliable. Where it is desired to use aluminum as the heating conductor, it has been found to be difficult to make a satisfactory and reliable electrical connection. This is so because aluminum is relatively soft and ductile. It has been known to attach a connector to a flexible laminate conductor by means of a pierce and crimp technique where the connector has teeth which pierce through the laminate and then are bent or crimped over to clamp the laminate and make the electrical connection. When insulating material covers both sides of the aluminum conductor and this technique is used, a poor electrical connection results. The use of bonding with an electrically conductive epoxy as described above overcomes most of this objection and provides a superior joint as compared to simple pierce and crimp methods.

Figure 3:
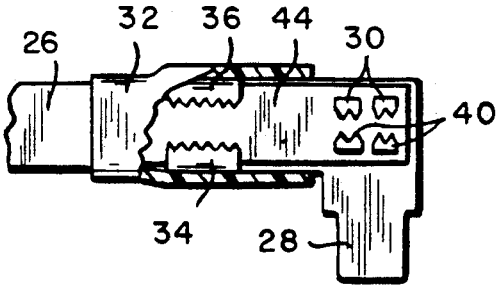
FIG. 3 is a view partially broken away to indicate an offset connector assembled to a flexible connector.

As shown in FIG. 3, a more secure method of attachment may be provided. In FIG. 3 there is shown the use of a multiplicity of teeth on wrap-around or enclasping arms 34,36 which do not pierce completely through the laminate. The laminate 26 is stripped to the metal on one side 38 (see FIG. 5) and may have an additional layer of polyester type fiberglass 44 for reinforcement purposes (see FIG. 5). In FIG. 3 a right-angle spade plug 28 is shown which may advantageously be made of aluminum. This spade plug is in contact on the underside of the flexible conductor with the exposed aluminum foil surface 38. A second series of crimping teeth 30,30 and 40,40 are provided on the connector 48 and a shrink tubing 32 is also employed.

Figure 5:
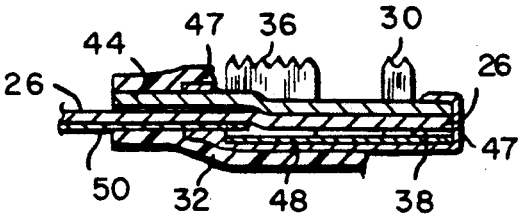
FIG. 5 is a cross-sectional view taken longitudinally through the connector of FIG. 3, but indicating the wrap-around arms in position to be crimp connected.

The method of assembly of the flexible conductor connector of FIG. 3 is further shown in FIG. 5 wherein the polyester and metal foil conductor laminate 26 (composed of at least two coverplys and adhesive as well as metal foil) has the bottom surface 38 of the aluminum foil stripped of coverplys and adhesive and is in contact with a stainless steel or aluminum connector 48. The laminate 26 may have additional multi layers 50 of coverplys and adhesive. The arms 36, 34 are shown in FIG. 5 in their upwardly extended position prior to crimping. An additional fiberglass reinforced polyester tape 44 is provided to increase the tensile strength of the combination. The crimping or bending over of the arms 34 and 36 will bring their respective teeth into contact with the tape 44 and the plastic laminate 26 and will force the surface 38 into contact with the connector 48. The teeth will be cushioned and will not pierce through to the metal. These teeth may slightly penetrate the plastic on the outermost surface but are not formed so as to engage the conductor on the innermost surface of the laminate after it is stripped. The resiliency of the laminate and the teeth of the connector maintain a positive electrical connection between the metal layer at surface 38 in the laminate with the connector 48.

The second set of teeth 30,30 and 40,40 pierce through all of the layers of laminate and form a hole therethrough and are then crimped over in order to provide a positive mechanical connection to lend strength and rigidity to the connector and conductor lead. It is found to be desirable to encapsulate the interconnection by applying a varnish coating 47 to encapsulate the interconnection and protect the aluminum from long term exposure to moisture and inherent oxidization of the surface. It has been found that the above arrangement works quite well because the aluminum is pressed against a stainless steel member by a resilient clamp with a resilient backing material behind the aluminum. The spring action of the teeth in conjunction with the resiliency of the polyester sheet apply constant pressure even during any slight long term cold flow of the foil. Because of the relative thinness of the foil layer, it is incapable of flowing to any great extent and the resilient spring action of the clamp will accommodate such flow without significant change in clamping force. Again, a covering of shrink tubing 32 is employed as in FIG. 3. The shrink tubing extends beyond the crimped arms 34,36 and acts as a strain relief and reduces flexure in the area of the connector. When subjected to severe thermal shock testing, it has been found that this interconnection will survive environmental extremes without noticeable degradation in performance or increase in resistance.

Figure 4:
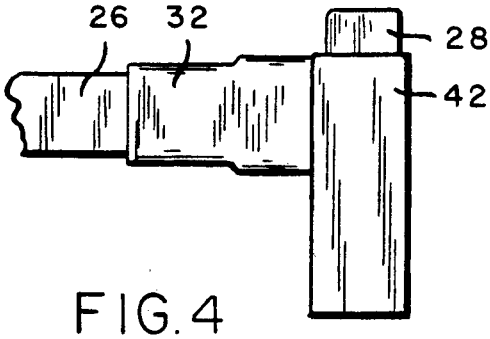
FIG. 4 is a plan view of the connector of FIG. 3, further modified to provide a pull tab.

As shown in FIG. 4, where a right angle spade plug is employed, it is useful to add a layer of fiberglass reinforced polyester tape 42 which is attached to the lead in the region of the connector and wrapped around it. This will enable ready application of pull force to remove or withdraw the spade 28 from the female plug connector in this critical and weak area.

Figure 6:
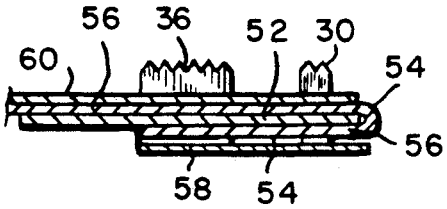
FIG. 6 is a view similar to FIG. 5, but of the opposed mating connector in a two-lead connector circuit.

Since the connector has a right angle bend and the device to be heated requires two connectors, they are oriented so that the plugs 28 face each other. The arrangement for attaching the opposite connector (to that shown in FIG. 5) is shown in FIG. 6 and is slightly different from that shown in FIG. 5. As shown in FIG. 6, a piece of fiberglass reinforced polyester tape 52 is applied to the end of the conductor. The bared end 54 of the flexible conductor 56 is then folded over the tape 52 so that its bared surface 54 is placed opposed to the stainless steel connector 58. In this construction, a laminate of coverplys and adhesive 60 forms part of the conductor 56. The method of crimping and clamping using the piercing teeth 30 and the enclasping teeth 34, 36 is identical to that discussed in connection with FIG. 5. Although, not shown in FIG. 6, a coating of varnish may also be applied similar to coating 47 in FIG. 5, as well as the use of shrink tubing 32.

It is to be noted in the foregoing that the small piercing teeth 30,30 and 40,40 are principally used to increase the pull strength of the joint. When used alone they provide an unreliable electrical connection to the foil. The two large enclasping multi-tooth assemblies 34 and 36 provide additional pull strength but are primarily employed to create the reliable electrical connection between the foil and the plug.

It was found that where only a set of piercing teeth are employed with the laminate, very little contact is made with the conductor and very little strength is provided. When subjected to test, a typical result was that a resistance of 4 ohms was obtained with this type of connection. By employing the wrap-around teeth 34,36, as shown in FIG. 3 for example, together with the piercing teeth 30,30 and 40,40, a resistance of 0.05 ohms was obtained. This resistance was maintained during temperature cycling of 10 cycles from −55° C. to +25° C. If a conductive adhesive such as 20 was used, a typical resistance was 0.0003 ohms and the connection could withstand 200 temperature cycles from −55° C. to +125° C. with no measurable degradation in performance.

Whereas specific features of construction have been shown and described, it is clear that various rearrangements of parts and modifications may be employed. Thus, for example, the use of the silver flake conductive adhesive 20 may be employed together with the use of the crimping teeth, and this has been found to be particularly effective where extremely low resistance is required, or where it is necessary to withstand severe environmental conditions.

What is claimed is:

1. A flexible conductor connector comprising a flat metal foil conductor laminated with plastic coatings, a metal spade plug connector, said foil conductor having a portion of its laminate removed to the bare metal, said metal spade connector having a flat surface in facing contact with said bare metal and a portion thereof wrapped around the laminated conductor and crimped to said plastic coating surface so as to pressure engage said flat surface of the metal connector to the base metal surface of the foil conduct, and said conductors encapsulated with metal varnish.

2. A method of fabricating a flexible conductor connector comprising the steps of:

providing a flat metal foil laminated with layers of plastic coatings, providing a metal spade plug connector, removing a portion of laminate down to the bare metal foil at the end of and on only one side of the flat metal conductor, forming a pair of crimping arms on said metal spade plug connector with a plurality of teeth at the ends of said arms, assembling the metal spade plug connector to the bare metal foil side and bending the crimping arms around the flat metal laminate conductor so as to enclasp said laminate on the opposite side of the bare metal foil side and simultaneously apply pressure to maintain a surface of the metal connector in contact with the bare metal foil and, applying electrical varnish to encapsulate the spade plug connector and flat metal conductor over the area of their interconnection.

3. A method of fabricating a flexible conductor connector comprising the steps of:

providing a flat metal foil laminated with layers of plastic coatings, providing a metal spade plug connector, removing a portion of laminate down to the bare metal foil at the end of and on only one side of the flat metal conductor, forming a pair of crimping arms on said metal spade plug connector with a plurality of teeth at the ends of said arms, assembling the metal spade plug connector to the bare metal foil side and bending the crimping arms around the flat metal laminate conductor so as to enclasp said laminate on the opposite side of the bare metal foil side and simultaneously applying pressure to maintain a surface of the metal connector in contact with the bare metal foil, wherein said spade area is at an angle to said foil conductor, assembling a thick wall plastic shrink tube over the connector and foil conductor at their juncture including the pair of extended arms and leaving only the spade area of the plug connector uncovered, and wrapping a layer of plastic tape over the connector and extending it in a direction in line with and leading away from the spade area to provide a pull tab to aid in disconnecting the spade plug from a female connector.

4. A method of fabricating a flexible conductor connector comprising the steps of:

providing a flat metal foil laminated with layers of plastic coatings, providing a metal spade plug connector, removing a portion of laminate down to the bare metal foil at the end of and only on one side of the flat metal conductor, forming a pair of crimping arms on said metal spade plug connector with a plurality of teeth at the ends of said arms, assembling the metal spade plug connector to the bare metal foil side and bending the crimping arms around the flat metal laminate conductor so as to enclasp said laminate on the opposite side of the bare metal foil side and simultaneously applying pressure to maintain a surface of the metal connector in contact with the bare metal foil, wherein said spade area is at an angle to said foil conductor, assembling a thick wall plastic shrink tube over the connector and foil conductor at their juncture to completely cover such juncture including the pairs of extended arms provided for piercing and crimping, and leaving only the spade area of the plug connector uncovered, and wrapping a layer of plastic tape over the connector and extending it in a direction in line with and leading away from the spade area to provide a pull tab to aid in disconnecting the spade plug from a female connector.

* * * * *